United States Patent [19]

Dreyer, Jr.

[11] Patent Number: 5,020,173

[45] Date of Patent: Jun. 4, 1991

[54] BEDSTEAD STORAGE BOX

[76] Inventor: John F. Dreyer, Jr., 6 Lost Rock La., St. Paul, Minn. 55127

[21] Appl. No.: 301,593

[22] Filed: Jan. 24, 1989

[51] Int. Cl.[5] ..... A47C 19/22

[52] U.S. Cl. ..... 5/308; 297/193; 5/166.1

[58] Field of Search ..... 5/308, 58, 118, 133, 5/161 R, 441; 297/193

[56] References Cited

U.S. PATENT DOCUMENTS

| | | | |
|---|---|---|---|
| 646,921 | 4/1900 | Smallwood et al. | 5/58 |
| 676,215 | 6/1901 | Bedell | 5/58 |
| 1,475,860 | 11/1923 | Oliver . | |
| 1,480,853 | 1/1924 | Diamond | 5/308 |
| 2,033,795 | 3/1936 | Ward, Jr. | 5/58 |
| 2,239,877 | 4/1941 | Ciullo | 5/308 |
| 2,692,009 | 10/1954 | Warshaver | 5/58 |
| 2,956,290 | 10/1960 | Scheinerman | 5/308 |
| 3,909,857 | 10/1975 | Herrera | 5/164 R |
| 4,370,766 | 1/1983 | Teague, Jr. | 5/164 R |
| 4,663,516 | 5/1987 | Blum | 5/449 X |

FOREIGN PATENT DOCUMENTS

| | | | |
|---|---|---|---|
| 161788 | 5/1933 | Switzerland | 5/58 |
| 473558 | 10/1967 | Switzerland | 5/164 R |

OTHER PUBLICATIONS

Pages from brochure of Stabilus Industrie und Handels GMBH D 6400 Koblenz Germany. One page shows several applications of gas springs, including use for skylight and use for raising cabinet style hide-a -bed. Another page shows adjustable hospital bed having gas spring assists.

*Primary Examiner*—Eric K. Nicholson

*Attorney, Agent, or Firm*—Frederick A. Fleming

[57] ABSTRACT

The bedstead storage box may be adapted as a bedstead for any regular-size bed, including king-size. It includes a shallow box to support the bed off the floor, a lid to carry a bed assembly including the springs, mattress and bedding, hinges to position the lid on the box and to serve as fulcrum when the lid is raised, gas springs disposed between the lid and box to counterbalance the weight of the load when opening the box, and a lock to secure the box in the closed position. If the bedstead storage box is to be situated with the hinged side adjacent to a wall, the use of an elevated hinge permits the bed to stand closely adjacent to that wall without interference when raising the lid.

3 Claims, 4 Drawing Sheets

BEDSTEAD STORAGE BOX

BACKGROUND OF THE INVENTION

1. Field of the Invention

The invention is in the field of bedsteads with bottoms having receptacles, drawers, and compartments, Class 5, Subclass 308, and the related field of sofa beds, Class 5, Subclass 58.

2. Prior Art

To use the space beneath a bed or a sofa for storage has been an objective shown in the patent literature for more than a hundred years, and in all likelihood, an objective that has been sought for ever since man first raised his bed up from the ground. The space underneath regular-size beds, as distinguished from sofa beds, has been adapted for drawers of various kinds which slide out to the side of the bed, for example U.S. Pat. No. 164,290 to Julia B. French, June 8, 1875. H. A. Scheinerman, U.S. Pat. No. 2,956,290, Oct. 18, 1960, substituted the box spring of a bed with a box and gained access to the box from the head and foot ends by elevating one third sections of the mattress on a platform that was divided in thirds by two transverse sets of hinges, with support for the elevated sections provided by a prop. Sofas which have the cushioned part mounted on the hinged lid of a storage box are represented many times in the patent literature. U.S. Pat. No. 984,685 to J. Luppino, Feb. 21, 1911, for example, shows such a box couch with a coil spring counterweighted hinged lid.

The success of the instant invention is due to the remarkable application of a relatively new hardware item, the so-called "gas spring." The application of gas springs most familiar to our contemporaries is the device found on our "hatchback" automobiles to assist in raising the hatch door. In the literature of the manufacturers of gas springs may be seen a variety of suggested applications for gas springs, including their use as adjuncts in hospital beds to permit comfort adjustments. Nowhere, to my knowledge or study, has the gas spring ever before been applied as I have used it, to permit the easy raising and lowering of a regular-size bed assembly complete with mattress, springs, and bedding, for access to the voluminous space beneath the bed.

The Problem

The problem is to provide storage space within the confines of an existing living space—to discover space that has been overlooked or misused, and to put that space to productive use. The problem is found in acute form in the efficiency apartments of our crowded cities. The problem is seen in a unique form in rental vacation condominium apartments, where there is an owner who uses the apartment for short periods during the year but who otherwise rents to vacationers. The owner needs secure space for storage of certain personal goods such as sports equipment and casual clothing that he needs only when occupying the apartment. It is commonplace for the "owner's locker" to be violated by renters, and a secure, inconspicuous owner's locker is a long-felt need.

The invention in its completed form was reached through a succession of steps, each of which ushered in new problems. The solution to the major problem was to gain access to the space beneath the bed by putting the bed assembly on a platform hinged to a shallow box at one of the four sides. The next problem was how to overcome the weight of the bed in raising the bed up through an angle that would permit access to the box. That problem was solved with the use of gas springs, but another problem was encountered: If the bedstead storage box is situated with the hinged side adjacent to a wall it must be spaced away from that wall in order to avoid conflict between the bed assembly and the wall when the bed is tilted open, which is a waste of space.

SUMMARY OF THE INVENTION

The bedstead storage box is a shallow rectangular box of dimensions comparable to the mattress for the bed, the box having four upright sides and a bottom, and a lid for the box to carry a bed assembly including springs, mattress and bedding, the lid comprising a platform supported on a frame that is hinged to one of the sides of the box so that it may be tilted upward at an angle by raising the lid at the side opposite the hinged side, to gain access to the space within the box, and gas spring counterforce means operating between the box and the lid to counterbalance the weight of the lid and bed assembly. If the hinged side of the bedstead is to stand adjacent to a wall, an elevated hinge axis may be provided to minimize interference of the bed assembly with the wall when the lid is tilted open.

It is an object of the invention to provide access to the space beneath a bed for storage of personal goods, wherein the lid and bed assembly may be easily tilted upward through an angle sufficient to afford access to the space within the box, and to provide this function in a manner that does not immediately reveal that the storage space exists, and further to provide that the box may be locked in the closed position.

My invention solves the problem of the owner's locker, providing for the first time, full access to the space underneath a regular-size bed, particularly a king-size bed, for storage. Since its introduction in the Florida condominium market less than a year ago, my bedstead storage box has received substantial acceptance and is on its way to being a commercial success.

DESCRIPTION OF THE PREFERRED EMBODIMENT

Introduction

Figure 1:
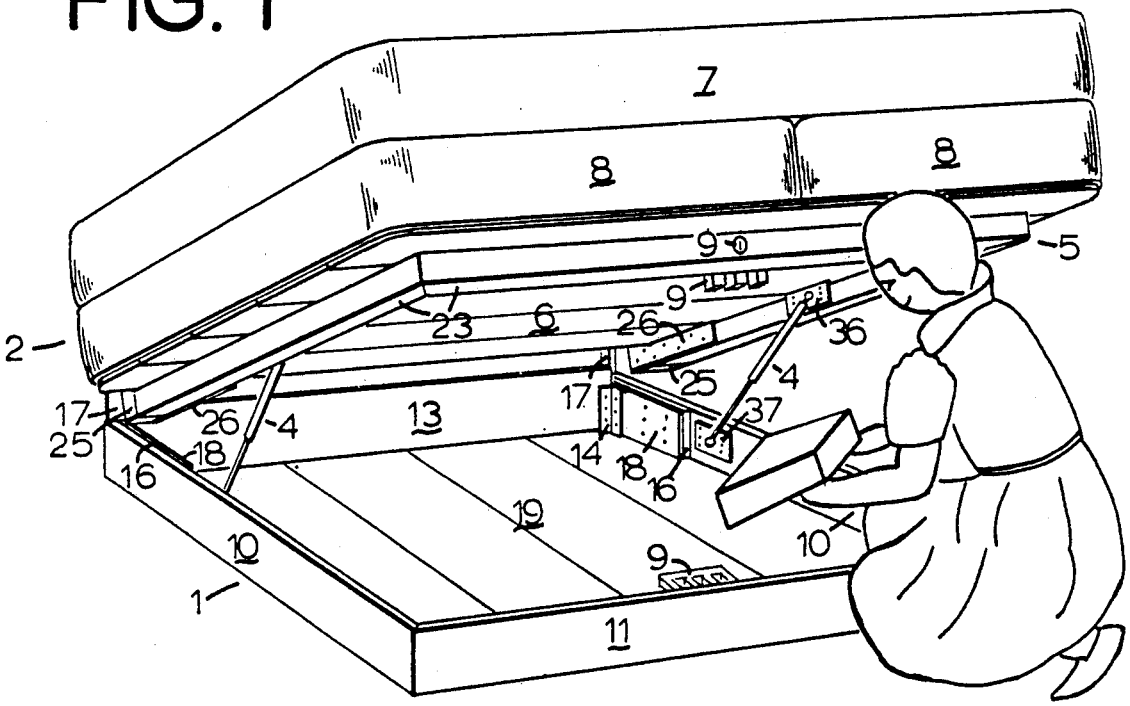
FIG 1 is an oblique perspective view of my king-size bedstead storage box illustrated with box springs and mattress.

The preferred embodiment of my bedstead storage box (FIGS. 1, 2) includes a shallow rectangular box 1 with four upright sides and a bottom 19 that rests on the floor of a bedroom. A lid 2 for the box is hinged at one side of the box by elevated hinges 3 and counterweighted with gas springs 4. The lid is a frame 5 with a platform 6 (FIG. z) to support a bed assembly including a mattress 7, box springs s, and bedding (not illustrated).

This description will feature the bedstead storage box of size to accommodate the contemporary "king-size" mattress and accompanying box spring pair. The bedstead storage box is adaptable for use with other regular-size beds--the single, the full and the queen, and size variations thereon. The most dramatic amount of storage is provided by the king-size storage box, which affords 22.5 cubic feet of storage space, which challenges the storage volume of the popular 36"×18"×72" steel cabinet, which affords 27 cubic feet.

The ease of opening and closing the bedstead storage box is remarkable and must be experienced to be fully appreciated.

This account will describe the construction of the box 1, the lid 2, the elevated hinge 3, the gas springs 4 for easing the opening and closing of the lid and the mechanics of their operation, the lock 9 provided for securing the contents of the box from unauthorized access, and the design of the parts of the box for shipment within the standard containers of the United Parcel Service company.

Figure 2:
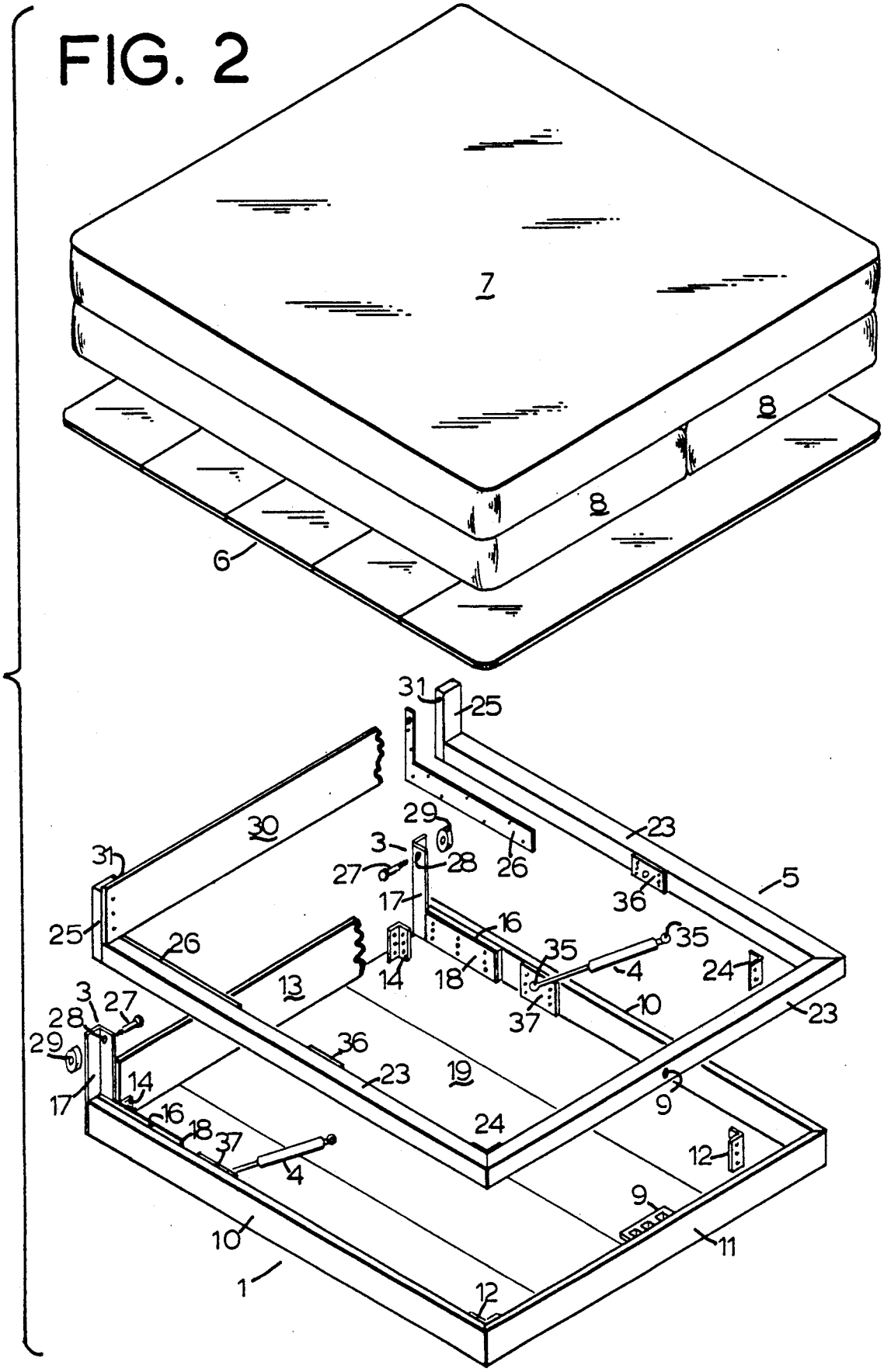
FIG. 2 is an isometric projection of the bedstead storage box,/ partly disassembled and exploded to show the relationship of the parts and with some parts broken away to reveal detail.
Figure 3:
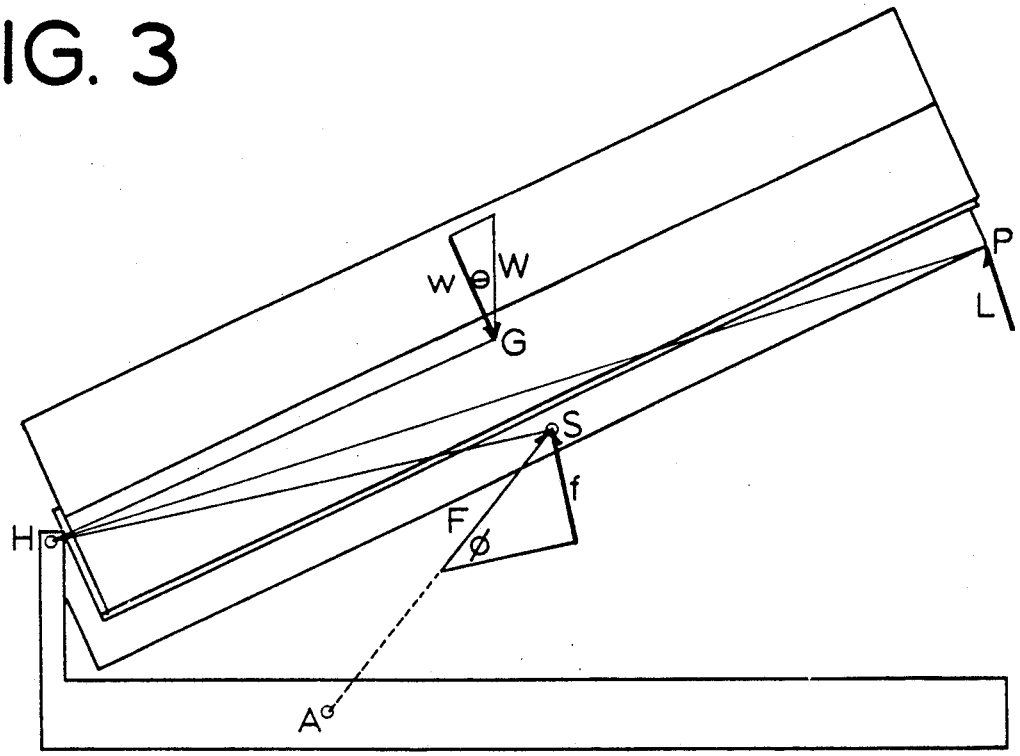
FIG. 3 is a schematic side elevation of the bedstead storage box, overlaid with lines to indicate moment arms and with vector diagrams to show the forces normal to the moment arms.

The Box, Lid, and Elevated Hinge (FIGS. 1, 2, 3)

The base of the bedstead storage box is a rectangular wooden box 1 of width and length scaled somewhat smaller than the lid 2, to provide that the sides of the box are recessed under the sides of the bed assembly by an amount (see FIG. 1) to afford toe room for a person standing next to the bed, and to give the completed bed an appearance compatible with contemporary design. The term <somewhat smaller> as used above is not some exact length, but is defined in terms of toe room, and is no greater than the length of the instep of one's foot.

The two parallel sides 10 and the side 11 opposite the hinged side of the box are of wood plank construction and are joined at the corners with miters reinforced with lengths of angle iron 12 fastened with wood screws. The hinged side 13 of the box is a wooden board of width equal to the total depth of the storage space and it is set in from the extreme end of the box and it is attached to the adjacent sides 10 by means of lengths of angle iron 14 secured with wood screws.

The bottom 19 of the box is made from several flat sections of plywood or chipboard of size acceptable for shipment by United Parcel Service, the assembled bottom having dimensions slightly smaller than the dimensions of the box, so that its edges are inconspicuous when the box is standing in a carpeted room. The bottom sections are attached to the bottom faces of the four sides with wood screws.

The platform 6 is also made from several flat sections of plywood or chipboard of size acceptable for shipment by United Parcel Service, and its overall rectangular dimensions are just slightly smaller than the rectangular dimensions of the mattress to be accommodated by the bedstead, providing thereby that a person accidentally bumping into the side of the completed bed will first encounter the soft bed assembly rather than the hard edge of the platform. The platform is 6 is supported by and secured to a U-shaped, three-sided frame 5 of wooden beams 23 with mitered corners reinforced with pieces of angle iron 24 fastened with wood screws. To participate in the elevated hinge at the free end of each side beam, an upright strut 25 is fixed and reinforced with a steel el plate 26 which is fastened to the inside face of each strut and to the inside face of each side beam. The el plates are secured with wood screws.

An endboard 30 completes the lid frame, being secured to the faces of the struts 25 with wood screws (FIG. 2). The endboard serves to keep the bed assembly from sliding off the lid when the lid is tilted to gain access to the box. The wooden frame 5 is designed to provide that the inside faces of the beams 23 are flush with the inside faces of the planks 10, 11 comprising the box. The beams are thicker than the planks making up the sides of the box, with the result that the outside faces of the beams slightly overlie the planks. A foam rubber pad (not illustrated) is bonded to the undersurface of the beams to cushion the lid to seat noiselessly upon the planks.

Figure 4:
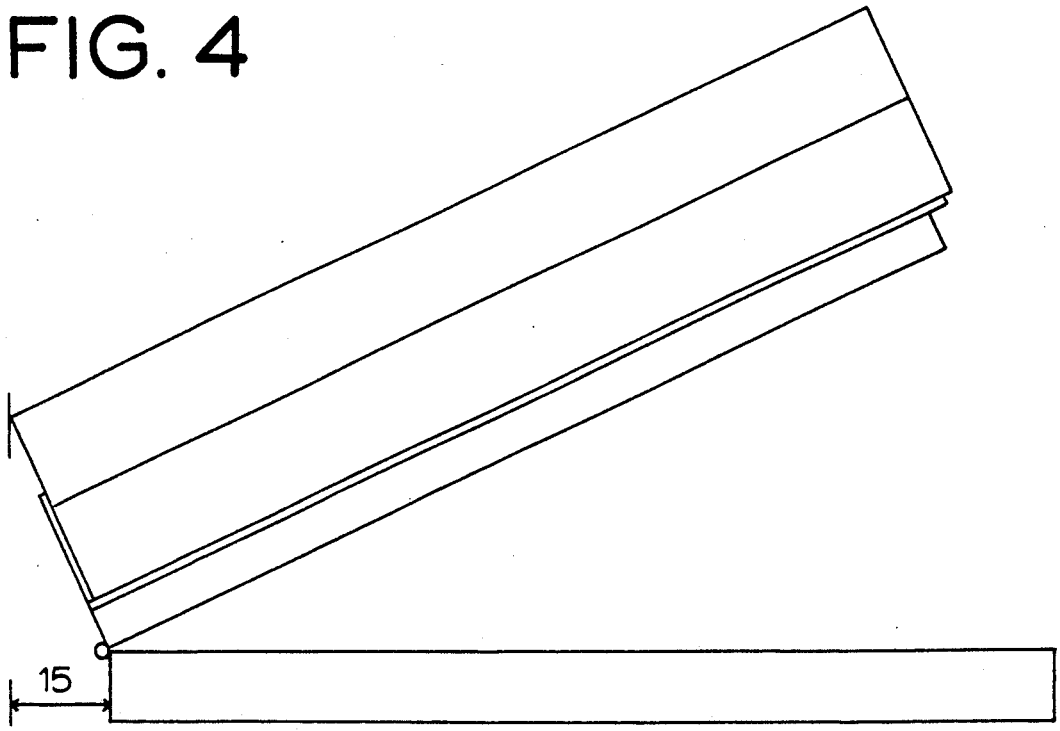
FIG. 4 is a schematic side elevation of the bedstead storage box with the hinge in an alternative position, to illustrate a problem.

In an early example of my bedstead storage box the lid was hinged directly to the top edge of one side of the box, as shown in FIG. 4, with the unwanted result that if the hinged side of the box were situated closely adjacent to a wall the bed assembly at the hinged side of the bed conflicted with the wall next to it when the lid was tilted open, and necessitating that the hinged side of the bed be spaced away from the wall to provide clearance against the conflict, as indicated by the line 15 (FIG. 4). I solved that problem by elevating the hinge axis to a height closer to the top surface of the mattress of the completed bed as shown in FIG. 3. Another demand placed on the design of the hinge is that it be hidden, because it is an objective of the invention to provide an inconspicuous owner's locker for rental vacation condominiums.

As shown in FIG. 2, to elevate and hide the hinge, I built up the ends of the planks comprising the sides 10 of the box with the shim boards 16, to support angle iron uprights 17 fixed to the ends. An aperture 31 in the top inside face of the each of the two uprights serves to establish the hinge pivot axis. Each angle iron upright 17 is welded to a steel reinforcement plate 18 that faces on the corresponding shim board 16 and is secured thereto with wood screws. To accommodate the uprights 17, the hinged side 13 of the box is recessed from the extreme end of the box, as reported above.

The common pivot axis of each elevated hinge 3 is parallel with the side 13. Lag bolts 27 are used for hinge pins. The threaded end of each lag bolt is screwed into the upright wooden struts 25 through apertures in the el plates 26. Corresponding apertures 28 in the angle iron uprights 17 serve as journal bearings for the necks of the lag bolts and define the hinge pivot axis.

To avoid a shearing action on any object that might inadvertently enter the angle between the upright el plate 26 and the upright angle iron 17 during opening and closing the lid, those members are spaced apart by a thick washer 29 that is intermediate on the neck of the lag bolt.

The hinge mechanism, being constructed within the recess at the hinged side of the bed, and having no parts showing on the outside of the bed, is completely hidden from view, and gives no suggestion that the bed serves for storage.

The Gas Springs

The type of spring that I use in my bedstead storage box, the so-called gas spring, has been available only in recent years and may be purchased from specialty hardware outlets such as Eberhardt Manufacturing Co., of Cleveland, Ohio, which distributes the goods of the Gas Spring Corp. of Colmar, Pennsylvania. Such springs have found many remarkable applications but have never before been used for a bedstead storage box as I have done in this invention.

Figure 5:
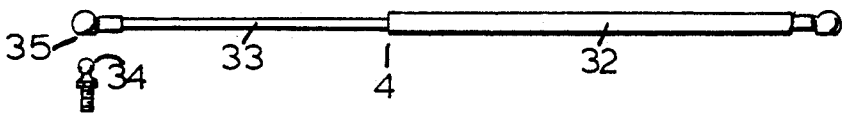
FIG. 5 is a side elevation of a gas spring of the type used in the invention.

The gas spring 4 (FIG. 5) is an elongate cylindrical sleeve 32, one end being closed and adapted for movable attachment to an anchor point, the other end having an aperture sealed upon a piston rod 33 that is fixed to a movable piston within the cylinder and which is adapted for movable attachment to a second anchor point at its outer end. The piston divides the volume of the cylindrical sleeve into two chambers that communicate by means of a small aperture drilled through the body of the piston. When manufactured, the cylinder is charged with an inert gas at high pressure, and because the face of the piston in the chamber containing the piston rod is smaller than the opposite face by an area equal to the cross-sectional area of the piston rod, and since pressure times area equals force, the net force tending to extend the piston rod is greater and provides the spring force. When the piston rod is retracted into the cylinder, the total volume is reduced by the volume occupied by the rod, so that the inert gas pressure is greatest (Boyle's law) and the force exerted by the gas spring is at its maximum. The force for any stage of piston extension is represented by the line $f_1f_2$ of the graph, FIG. 6.

If the piston of a given gas spring is fully retracted by the action of some external force and if that force is suddenly removed, the rate of extension of the piston rod will be moderated by the rate of flow of the compressed gas through the communicating aperture in the body of the piston. Such moderated spring action is very desirable in the application that I have now made of gas springs in my bedstead storage box.

Figure 6:
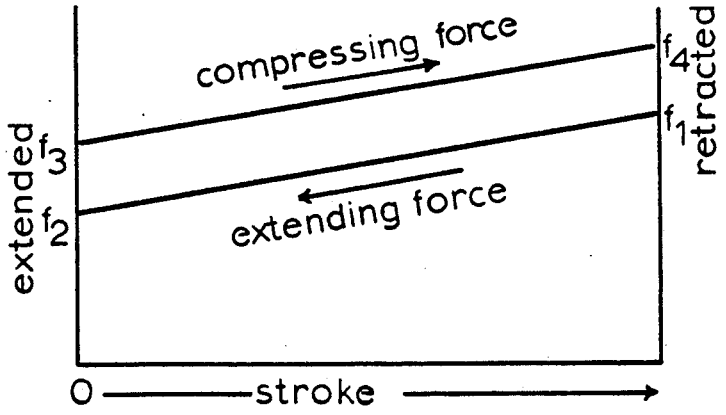
FIG. 6 is a graph showing the relationship between the force of the gas spring and extension of the piston rod.

When the piston rod is extending, the force required to arrest extension is just equal to the spring force, but to reverse the piston rod, an additional increment of force to overcome hysteresis must be applied, as indicated by $f_2f_3$ in FIG. 6. In the case of the gas springs that I use in my king-size bedstead storage box, the maximum spring force $f_1$ is 250 pounds, the minimum force is 192 pounds, and the hysteresis force is ten pounds. A one-way valve in the body of the piston facilitates the flow of compressed gas between the chambers during retraction of the piston, but the retraction is nonetheless moderated by the expansion force of the spring, a characteristic of the gas spring which, together with the moderated extension force, works to provide the very desirable controlled opening and closing behavior of the bedstead storage box.

Each gas spring 4 is attached at its cylinder end to an anchor point on the inside surface of the frame of the lid by means of a ball joint, the socket 35 being at the end of the spring and the ball 34 being the outer end of a lug mounted to a metal reinforcing plate 36. The piston rod end is attached to an anchor point on the inside surface of the side of the box with a similar ball and socket joint and reinforcing plate 37.

Reading the drawings, FIGS. 1, 2, 3, it is seen that one end of each gas spring is attached to a side of the lid at a point approximately midway from the hinged end to the opposite end of the lid. The other end of each gas spring is orientated toward the hinge side of the box and is mounted at a selected point on the inside face of the corresponding side of the box, to provide that the piston rod will be substantially fully retracted when the lid is closed, and to provide that the lid will be tilted at an angle of approximately 25 degrees when the piston rod is fully extended.

Mechanics of Operation

Referring to the schematic, FIG. 3, one may understand the physics of operation of the bedstead storage box. Every force tending to open or close the lid assembly works to rotate that body on the hinge, according to the law of the lever. Moment equals the product of the distance from the point where the force is applied to the fulcrum, i.e., the moment arm, times the component of that force normal to the moment arm.

Referring to FIG. 3, the point H is the hinge axis, the point G is the center of gravity of the bed lid assembly, W is a vector representing the weight of the bed lid assembly, and w is the vector component of the weight normal to the arm HG, where $w=W \cos\theta$. The closing moment is $HG \times w$.

The point S is the anchor point of the gas spring at the lid, F is a vector representing the force of the gas spring, and f is the vector component of that force normal to the arm HS, where $f=F \sin\phi$. The opening moment is $HS \times f$.

The point L represents a place on the end of the bed lid frame where a person would exert a force b to boost the lid toward an open position on the arm HL. The boosting moment is $HL \times b$.

The status of the bed lid assembly, whether tending to open or to close, depends on the arithmetic sum of the moments working to rotate the assembly around the hinge axis. As practiced in my invention these variables combine to provide a lid assembly that remains closed if undisturbed but may be opened with a small boost to an "over center" position above which it operates automatically and at moderate speed to its fully open position at the limit of extension of the piston rod. The boost applied by the person operating the bed, being applied at the end of the long arm HL, is augmented by a mechanical advantage, affording excellent control.

Figure 7:
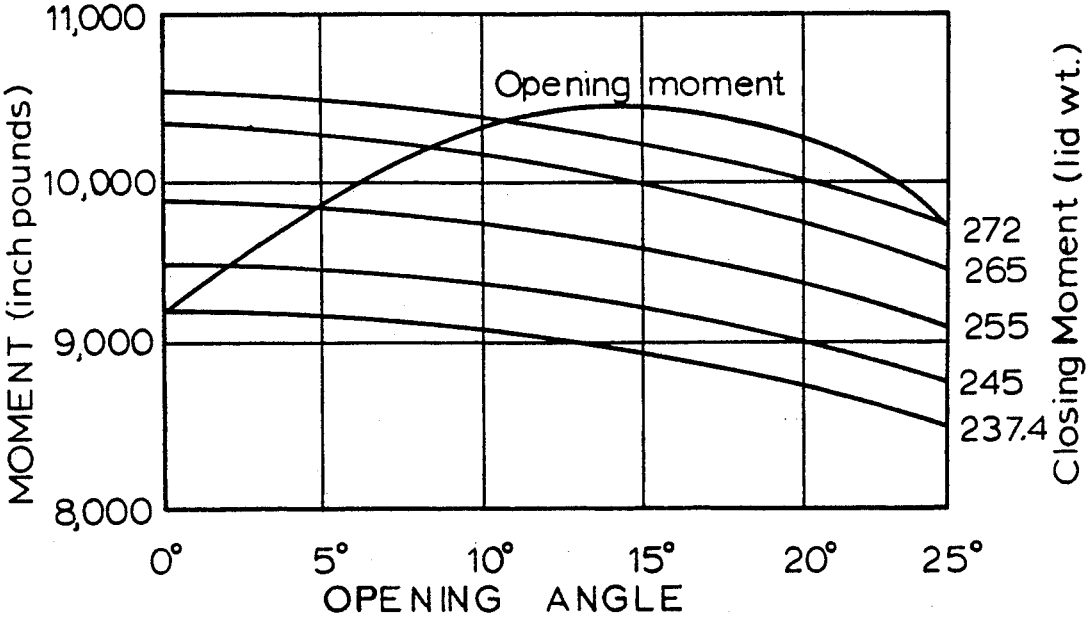
FIG. 7 is a graph showing the moments of force tending to open and close the lid and bed assembly of a king-size bedstead storage box having elevated hinges.

For a lid assembly as in FIG. 3, having a pair of gas springs of 250 pounds maximum spring force each, the opening moment has been found at angular intervals of five degrees, and plotted in the graph, FIG. 7. For the same assembly, the closing moment due to the weight of the assembly has been calculated in terms of W (the weight of the assembly) for the same angular intervals. The bed lid assembly weight $W_{min}$ to just maintain the lid in the closed position and the weight $W_{max}$ of the lid that will just stay in the fully open position are then found to be 237.4 and 272 pounds, respectively. The opening moments for lid assemblies for those weights, and for the arbitrary intermediate weights, 245-, 255-, and 265- pounds, have been found at five degree intervals, and are plotted (FIG. 7) as a set of similar curves.

The intersection of the opening moment curve with the closing moment curve for a lid assembly of a given weight then indicates the opening angle at which that lid assembly goes "over center," i.e., the angle at which the lid not longer tends to close but now tends to open. This information is assembled in the accompanying table.

TABLE

Boost Forces and Over-Center Angles for Representative King-size Bed Assemblies

| Weight of Bed Lid Assembly (pounds) | Boost Force to Open Lid (pounds) | Force to Close Lid (pounds) | Over-Center Angle (degrees) |
|---|---|---|---|
| 237.4 | nil | 24 | 0 |
| 245 | 4 | 20 | 2 |
| 255 | 8 | 16 | 5 |
| 265 | 14 | 11 | 8.3 |
| 272 | 17 | 8 | 10.7 |

The boost force needed to raise the lid from its closed position is equal to the product of the moment arm HL (FIG. 3) and the difference between the weight closing moment and the spring opening moment. The force to close the lid is found in the same way after correcting for hysteresis. This information is listed in the table.

It may be noted that if the weight of an exceptional bed lid assembly is heavier than the weight that can be controlled in the illustrated example, such heavier assemblies can be accommodated by moving the anchor points for the gas springs toward the foot end of the bed, which has the effect of increasing the moment arm Ms (FIG. 3), but at the expense of a smaller opening angle. For the arrangement illustrated in FIG. 3, the maximum opening angle is 25 degrees, which provides good access to the space within the box.

Locking Means

The bedstead storage box may be secured in the closed position with a lock such as a vertical deadbolt lock mounted inconspicuously at the foot of the bedstead. Note that "vertical deadbolt" is the locksmith's name for the common household surface-mounted security lock, and that as used here the bolt works horizontally. Some of the parts of the lock 9 will be recognized in FIGS. 1, 2.

What is claimed is:

1. A bedstead storage box for a regular-size bed, to support a bed assembly above a floor in a bedroom, the bed assembly including springs, mattress, and bedding, and to provide storage space underneath the bed assembly, comprising:

a rectangular box of four upright sides, a lid for the box to carry the bed assembly upon the upstanding faces of the four upright sides, means for hinging one side of the lid to a corresponding side of the box, to provide that the lid may be tilted upward, opening the box for access to the storage space within, said hinge means having a common pivot axis standing parallel with and adjacent to the hinged side of the box at a height closely approximating that of the box, two gas springs, one mounted at each of the two sides of the box adjacent to the hinged side, each gas spring selected to provide a spring force approximately equal to the combined weight of the lid and the bed assembly, and each spring having a stroke of approximately ten inches, each gas spring having one end swively mounted to the side of the lid at approximately mid-length and the other end oriented toward the hinged side of the box but swively mounted to a point on the inside face of the corresponding side of the box to provide that the spring is fully retracted when the lid is closed, and fully extended when the bed is tilted open through an angle of about twenty-five degrees, means for locking the lid in the closed position upon the box to provide security against unauthorized access to goods stored in the box.

2. An improvement in the bedstead storage box disclosed in claim 1, further comprising:

means for elevating the pivot axis to a position above the box height but below the overall height of the complete bed, thereby allowing the lid to be tilted open without conflict between the bed assembly and the wall of a bedroom, when the bedstead storage box is situated with the hinged side closely adjacent to that wall, and further, preserving the hidden character of the hinge means, which stand below and behind the bed assembly.

3. A bedstead storage box for a regular-size bed, to support a bed assembly above a floor in a bedroom, the bed assembly including springs, mattress, and bedding, and to provide storage space underneath the bed assembly, comprising:

a rectangular box of four upright sides, a lid for the box to carry the bed assembly upon the upstanding faces of the four upright sides, means for hinging a side of the lid to a corresponding hinged side of the box, to provide that the lid may be tilted upward, opening the box for access to the storage space within, said hinge means having an elevated pivot axis standing parallel with length of the hinged side of the bedstead storage box at a selected intermediate height between the box height and the height of the completed bed, wherein the elevated pivot axis height permits the lid carrying the bed assembly to be tilted upon without interference between the bed assembly and a wall situated adjacent to the side of the bed having the hinge means, said elevated hinge means further comprising:

an upright member fixed at the end of each of the two sides of the box adjacent to the hinged side of the box an upright strut fixed at each of the two corners of the lid on the side associated with the pivot axis, wherein the upright member and the upright strut at each corner stand as pairs, parallel and adjacent when the lid is in the closed position, in association with each pair of uprights at a selected elevated height of the pivot axis, a pivot shaft penetrating normal to the uprights, fixed in one upright and journaled within a bearing on the other upright, and two gas springs, one mounted at each of the two sides of the box normal to the hinged side, each gas spring selected to provide a spring force approximately equal to the combined weight of the lid and the bed assembly, and each spring having a stroke of approximately ten inches, each gas spring having one end swively mounted to the side of the lid at approximately mid-length and the other end oriented toward the hinged side of the box but swively mounted to a point on the inside face of the corresponding side of the box to provide that the spring is fully retracted when the lid is closed, and fully extended when the bed is tilted open through an angle of about twenty-five degrees, means for locking the lid in the closed position upon the box to provide security against unauthorized access to goods stored in the box.

* * * * *